US006614400B2

(12) United States Patent
Egorov

(10) Patent No.: US 6,614,400 B2
(45) Date of Patent: Sep. 2, 2003

(54) ANTENNA

(75) Inventor: Igor Egorov, Lund (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/908,817

(22) Filed: Jul. 20, 2001

(65) Prior Publication Data

US 2002/0019247 A1 Feb. 14, 2002

Related U.S. Application Data

(60) Provisional application No. 60/226,087, filed on Aug. 18, 2000.

(30) Foreign Application Priority Data

Aug. 7, 2000 (SE) ..... 0002839

(51) Int. Cl.[7] ..... H01Q 1/24; H01Q 1/38

(52) U.S. Cl. ..... 343/702; 343/700 MS; 343/846

(58) Field of Search ..... 343/702, 700 MS, 343/895, 846

(56) References Cited

U.S. PATENT DOCUMENTS

| | | | | |
|---|---|---|---|---|
| 4,571,595 A | | 2/1986 | Phillips et al. | 343/745 |
| 5,966,097 A | * | 10/1999 | Fukasawa et al. | 343/700 MS |
| 6,008,762 A | * | 12/1999 | Nghiem | 343/700 MS |
| 6,112,102 A | | 8/2000 | Zhinong | 343/895 |
| 6,147,652 A | * | 11/2000 | Sekine | 343/702 |
| 6,166,694 A | * | 12/2000 | Ying | 343/702 |
| 6,222,496 B1 | * | 4/2001 | Liu | 343/846 |
| 6,326,921 B1 | * | 12/2001 | Egorov et al. | 343/700 MS |

FOREIGN PATENT DOCUMENTS

| | | | |
|---|---|---|---|
| EP | 1024552 A2 | 8/2000 | |
| FR | 2800920 A1 | 5/2001 | |
| JP | 6-37531 | 10/1994 | H01Q/11/08 |
| JP | 7131234 A | 5/1995 | |
| JP | 1093332 A | 4/1998 | |
| WO | WO96/27219 | 9/1996 | H01Q/9/42 |
| WO | WO98/44588 A1 | 10/1998 | |
| WO | WO99/03168 A1 | 1/1999 | |

OTHER PUBLICATIONS

Rowell, Corbett R. et al.: "A Compact PIFA Suitable for Dual–Frequency 900/1800–MHZ Operation", IEEE transactions on antennas and propagation, Apr. 1998, vol. 46, No. 4, pp. 596–598.

K. Qassim, "Inverted–F Antenna for Portable Handsets", IEE Colloquium on Microwave Filters and Antenna for Personal Communication Systems, pp. 3/1–3/6, Feb. 1994, London, UK.

* cited by examiner

*Primary Examiner*—Hoang Nguyen
(74) *Attorney, Agent, or Firm*—Burns, Doane, Swecker & Mathis, L.L.P.

(57) ABSTRACT

The present invention relates to a built-in folded PIFA antenna for a radio communication device (400, 450) and a mobile phone (400) containing the same antenna. The built-in antenna comprises a first part (500) tuned to a first and a second frequency band, and a second part (600) electromagnetically interacting with the first part (500) and galvanically separated from the first part. While the second part (600) interacts with the first part, the antenna is tuned to a third frequency band. The first part (500) is folded to form a first element (510) and a second element (520), wherein the second element (520) is folded approximately 180 degrees in relation to the longitudinal axis of the first element (520).

45 Claims, 5 Drawing Sheets

ANTENNA

RELATED APPLICATIONS

This application claims priority under 35 U.S.C. §§119 and/or 365 to 0002839-9 filed in SWEDEN on Aug. 7, 2000; the entire content of which is hereby incorporated by reference. This application also claims priority under 35 U.S.C. §§119 and/or 365 to U.S. Provisional Application No. 60/226,087, filed Aug. 18, 2000.

FIELD OF THE INVENTION

The present invention relates to a communication device in a radio communication system, and a built-in antenna for a radio communication device.

BACKGROUND OF THE INVENTION

The present invention relates generally to radio communication systems and, in particular, to built-in antennas which can be incorporated into portable terminals and which allow the portable terminals to communicate within different frequency bands.

The cellular telephone industry has made phenomenal strides in commercial operations in the United States, Europe and the rest of the world. Growth in major metropolitan cities has far exceeded expectations and is rapidly outstripping system capacity. If this trend continues, the effects of this industry's growth will soon reach even the smallest markets. Innovative solutions are required to meet these increasing capacity needs as well as maintain high quality service and avoid rising prices.

Throughout the world, one important step in the advancement of radio communication systems is the change from analogue to digital transmission. Equally significant is the choice of an effective digital transmission scheme for implementing the next generation technology, e.g. time division multiple access (TDMA) as for example GSM, GPRS, D-AMPS or code division multiple access (CDMA) as for example CDMA2000, IS-95 or W-CDMA. Furthermore, it is widely believed that the next generation of Personal Communication Networks (PCNs), employing low cost, pocket-sized, cordless telephones that can be carried comfortably and used to make or receive calls and communicate with interactive data bases like the Internet in the home, office, street, car, etc., will be provided by cellular carriers using the next generation digital cellular system infrastructure as for example W-CDMA, GPRS or EDGE. To provide an acceptable level of equipment compatibility, standards have been created in various regions of the world. For example, analogue standards such as AMPS (Advanced Mobile Phone System), NMT (Nordic Mobile Telephone) and ETACS and digital standards such as D-AMPS (e.g., as specified in EIA/TIA-IS-54-B and IS-136) and GSM (Global System for Mobile Communications adopted by ETSI) have been promulgated to standardise design criteria for radio communication systems. Once created these standards tend to be reused in the same similar form, to specify additional systems. For example, in addition to the original GSM system, there also exists the DCS1800, GPRS (General Package Radio Service), EDGE (Enhanced Data rate for GSM Evolution) (specified by ETSI), PCS1900 (specified by JTC in J-STD-007), all of which are based on GSM.

The recent evolution in cellular communication services involves the adoption of additional frequency bands for use in handling mobile communication services, e.g., for Personal Communication Services (PCS). Taking the U.S. as an example, the Cellular hyperband is assigned two frequency bands (commonly referred to as the A frequency band and the B frequency band) for carrying and controlling communications in the 800 MHz region. The PCS hyperband, on the other hand, is specified in the United States to include six different frequency bands (A, B, C, D, E, F) in the 1900 MHz region. Thus, eight frequency bands are now available in any given service area of the U.S. to facilitate communication services. Certain standards have been approved for the PCS hyperband (e.g., PCS1900 (J-STD-136)), while others have been approved for the Cellular hyperband (e.g., D-AMPS (IS-136)).

Each one of the frequency bands specified for the Cellular and the PCS hyperbands is allocated a plurality of traffic channels and at least one access or control channel. The control channel is used to control or supervise the operation of the mobile station by means of information transmitted or received from the mobile stations. Such information may include incoming call signals, outgoing call signals, page signals, page response signals, location registration signals, voice channel assignments, maintenance instructions, handover, and cell selection or reselection instructions as a mobile station travels out of the radio coverage of one cell and into the radio coverage of another cell. The control and voice channels may operate using either analogue modulation or digital modulation.

The signals transmitted by a base station in the downlink over the traffic and control channels are received by mobile or portable terminals, each of which has at least one antenna. Historically, portable terminals have employed a number of different antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna.

As described above, it is commercially desirable to offer portable terminals which are capable of operating in widely different frequency bands, e.g., bands located in 900 MHz region, 1800 MHz region, 1900 MHz region and 2100 MHz region. Accordingly, antennas which provide adequate gain and bandwidth in all above frequency bands will need to be employed in the near future.

For example, U.S. Pat. No. 4,572,595 describes a dual-band antenna having a sawtooth-shaped conductor element. The dual band antenna is tuned to two different frequency bands. The antenna design in this patent is relatively insufficient since it is so physically close to the chassis of the mobile phone.

Japanese patent No. 6-37531 discloses a helix, which contains an inner parasitic metal rod. In this patent, the antenna can be tuned to dual resonant frequencies by adjusting the position of the metal rod. Unfortunately, the bandwidth for this design is too narrow for use in cellular communications.

Dual-band, printed, monopole antennas are known in which dual resonance is achieved by the addition of a parasitic strip in close proximity to a printed monopole antenna. While such an antenna has enough bandwidth for cellular communications, it requires the addition of a parasitic strip. Moteco AB in Sweden has designed a coil matching dual-band whip antenna and coil antenna, in which dual resonance is achieved by adjusting the coil-matching component (¼λ for 900 MHz and ½λ for 1800 MHz). This antenna has relatively good bandwidth and radiation performances and a length in the order of 40 mm. A non-uniform helical dual-band antenna which is relatively small in size is disclosed in copending, commonly assigned U.S. patent application Ser. No. 08/725 507, entitled "Multiple Band Non-Uniform Helical Antennas".

Presently, antennas for radio communication devices, such as mobile phones, are mounted directly on the phone chassis. However, as the size and weight of portable terminals continue to decrease, the above-described antennas become less advantageous due to their size. Moreover, as the functionality of these future compact portable terminals increases, the need arises for built-in miniature antennas, which are capable of being resonant at multiple frequency bands.

Conventional built-in antennas currently in use in mobile phones include microstrip antennas and planar inverted-F antennas. Microstrip antennas are small in size and light in weight. The planar inverted-F antenna (PIFA) has already been implemented in a mobile phone handset, as described by Q.Kassim, "Inverted-F Antenna for Portable Handsets", IEE Colloquium on Microwave filters and Antenna for personal Communication systems, pp. 3/1–3/6, February 1994, London, UK. More recently, Lai et al has published a meandering inverted-F antenna (WO 96/27219). This antenna has a size, which is about 40% of that of a conventional PIFA antenna.

FIGS. 1 and 2 illustrate the conventional planar patch antenna compared to the meandering inverted-F antenna described in Lai et al. The conventional planar patch antenna of FIG. 1 has both size and length equal to, for example, a quarter wavelength of the frequency to which the antenna is made resonant. The conventional planar antenna also has a width W. The meandering inverted-F antenna, illustrated in FIG. 2, also has a length equal to a quarter wavelength of the resonant frequency and a width equal to W; however, the size of the meandering inverted-F antenna is reduced to about 40% of the size of the conventional planar patch antenna. This reduction in size is attributable to the antenna's meandering shape.

However, as mobile phones become smaller and smaller, both conventional microstrip antennas and PIFA antennas are still too large to fit the future small phone chassis. In copending U.S. patent application Ser. No. 09/112,366, entitled "Miniature Printed Spiral Antenna for Mobile Terminals", a printed spiral built-in antenna with a matching post was proposed. The size of the antenna was reduced to 20–30% of the conventional PIFA antenna (less than 1/10 of the wavelength) thereby making it suitable for future mobile phones.

In addition to a reduced antenna size, next generation mobile phones will require the capability to tune to many frequency bands for cellular, wireless local area networks. In copending U.S. patent application Ser. No. 09/112,152, entitled "Twin Spiral Dual Band Antenna", a multiple band, built-in antenna was proposed which is suitable for future phones. The built-in antenna comprises two spiral conductor arms, which are of different lengths, and capable of being tuned to different frequency bands. In order to increase the bandwidth of the antenna, a resistor loading technique is introduced. In another copending U.S. patent application Ser. No. 09/212 259, entitled "Printed Multi Band Antenna", a built-in patch antenna is provided which includes patch elements of different sizes and capable of being tuned to different frequency bands as can be seen in FIG. 3.

A drawback with the above described antennas is that they are still too large and they have problems tuning to multiple frequency bands while simultaneously having a broad bandwidth in each of these multiple frequency bands.

The object of the present invention is to overcome this drawback.

SUMMARY OF THE INVENTION

The above object is achieved by means of a communication device in a radio communication system, and a built-in antenna as claimed in claims 1 and 22.

Thanks to the interaction between the parasitic element and the main radiator according to claims 1 and 22, the antenna gets a very broad bandwidth at the higher frequencies.

In a preferable embodiment as claimed in claim 8, the main radiator is folded into two radiating elements, wherein one of the elements is folded approximately 180 degrees in relation to the other element. Thanks to the folding of the antenna the resonance at the higher frequency bands could be decreased in the frequency spectrum.

In another preferable embodiment of the invention, the parasitic element of the antenna is arranged in the vicinity of, and in parallel with the main radiator achieving a good interaction between the parasitic element and the main radiator.

In yet another embodiment according to claim 12, the ground pin of the parasitic element is arranged in close vicinity of the feeding pin of the main radiator achieving good matching and tuning of the antenna.

The main radiator containing the two radiating elements and the parasitic element are preferably arranged on a substrate (plastic or ceramic), said substrate being mounted on a Printed Circuit Board (PCB) as is claimed in claim 17.

In another preferable embodiment of claims 21 and 45, the folded built-in PIFA is attached to the back cover of the mobile phone in order to increase the antenna bandwidth by increasing the distance between the radiator and the printed circuit board of the phone.

Other characteristics of the invention are set out in the other dependent claims.

BRIEF DESCRIPTION OF THE DRAWINGS

The present invention will now be described in more detail with reference to preferred embodiments of the present invention, given only by way of examples, and illustrated in the accompanying drawings in which.

DETAILED DESCRIPTION OF EMBODIMENTS OF THE INVENTION

Figure 1:
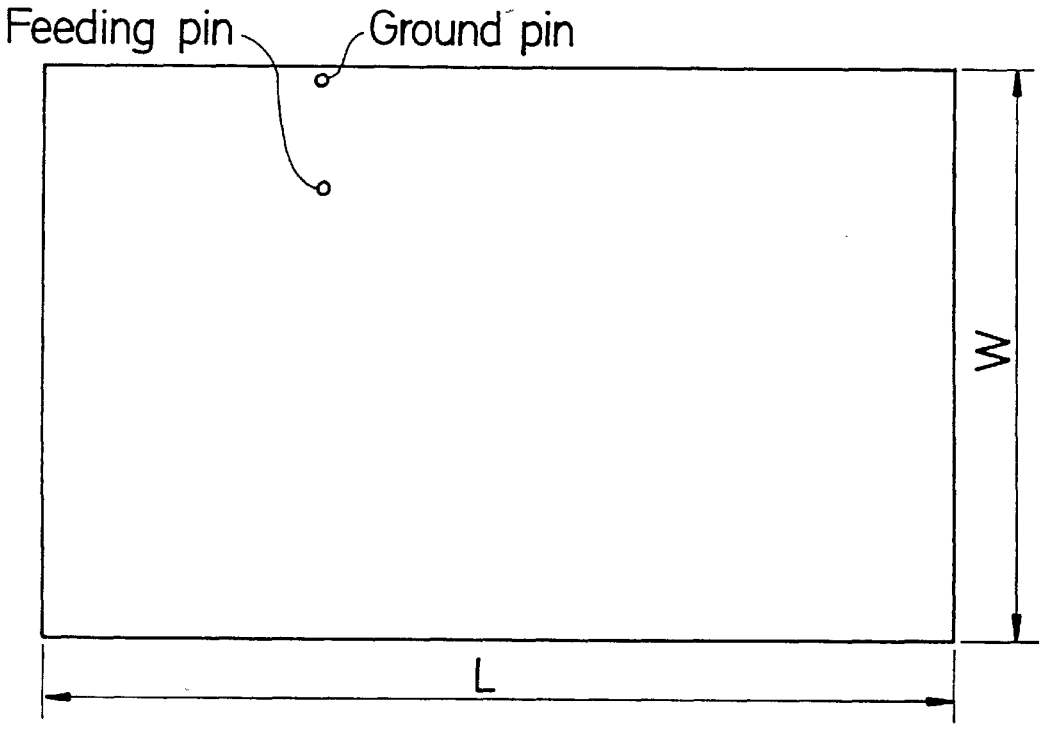
FIG. 1 illustrates a conventional built-in PIFA.
Figure 2:
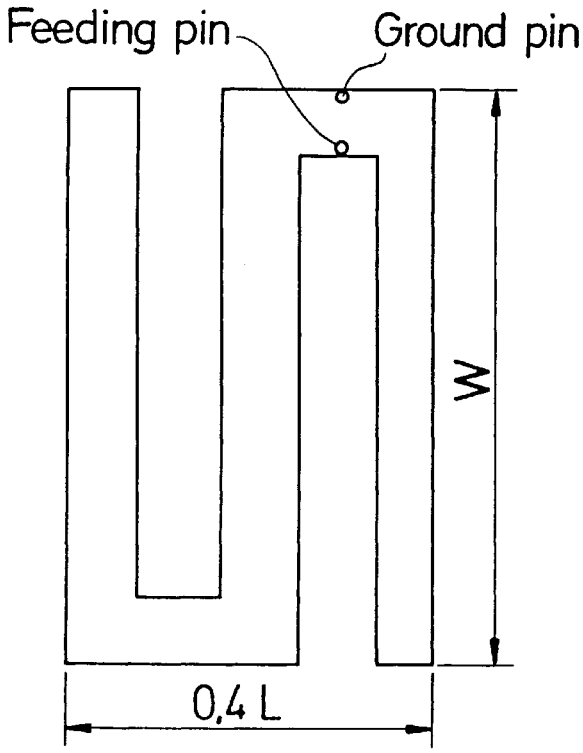
FIG. 2 illustrates a built-in meandering inverted F-antenna.
Figure 3:
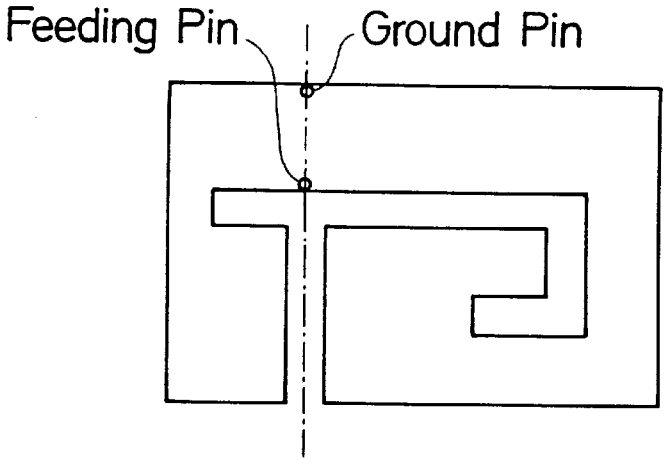
FIG. 3 illustrates another built-in PIFA.
Figure 4:
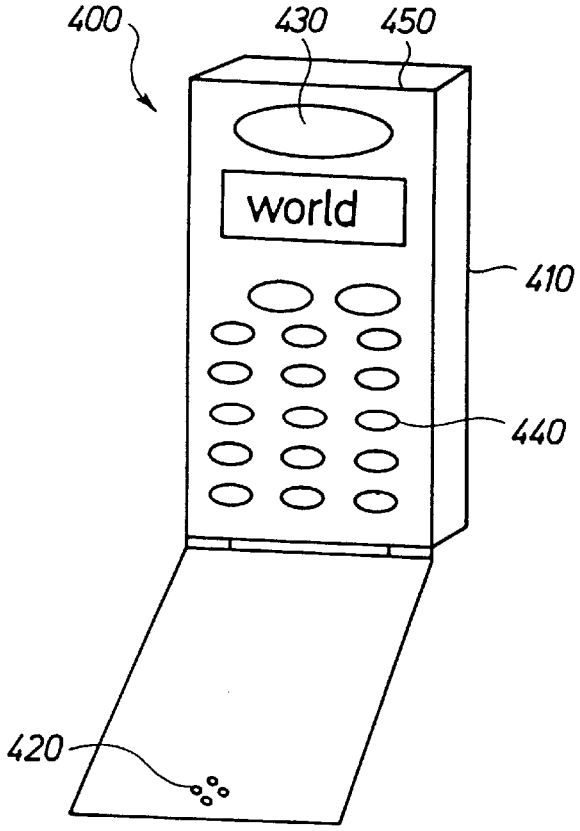
FIG. 4 illustrates a radio communication device in which the antenna of the present invention may be implemented.

FIG. 4 illustrates an exemplary radio communication device 400 in which the built-in multiple band folded PIFA antenna of the present invention may be implemented. Communication device 400 includes a chassis 410 having a first interface 420, 440 for allowing the communication device to receive information from the user and a second interface 430 for allowing the communication device to transfer information to the user. It should be realized that this first interface could be a microphone, a keypad, a touchpad, a radio-port, an IR-port, a computer-port and/or a Bluetooth-port. It should also be realized that the second interface could be for example a speaker, display, radio-port, computer-port, Bluetooth-port etc. For example, the communication device according to the invention could be a CocaCola vending machine receiving a radio/Bluetooth signal from a mobile phone requesting a purchase of a Coke, first interface, and sending an acknowledgment by radio or Bluetooth, second interface, to the same mobile phone when the purchase has been completed. Preferably the communication device 400 is a mobile telephone with a microphone opening 420 and a speaker opening 430 located next to the position of the mouth and the ear, respectively, of the user. A keypad 440 allows the user to interact with the mobile telephone, e.g., by inputting a telephone number to be dialled. The mobile phone 400 also includes the folded PIFA antenna with a parasitic element 450 according to the present invention, the details of which will be described below. However, it should be realized that the folded PIFA antenna according to FIG. 5 without the parasitic element could be implemented in the mobile phone 400 achieving a good antenna performance.

The antenna of the present invention, which is to be implemented in the above discussed communication device, represents a folded grounded patch antenna (PIFA) with a grounded parasitic element. A parasitic element is not galvanically connected to the radiating antenna but is only connected to the ground plane. Thus, the radio signal fed to the radiating antenna is capacitively coupled to the parasitic element. Consequently, the radiating antenna together with the parasitic element will due to this coupling resonate at another frequency band, e.g., the PCS band. The capacitive coupling of the parasitic element to the main antenna results in this case in three resonances, two of which can be adjusted to lie next to each other thus creating a broad resonance. The antenna size can be as small as 45 mm×20 mm, and the height of the antenna over the ground plane could be as small as 8 mm. The antenna in the present invention has broad bandwidth at high band covering at least the DCS and the PCS band. The other resonance occurs at the GSM band. Consequently, the antenna is functional at, at least three frequency bands, i.e., GSM (880–960 MHz), DCS (1710–1880) and PCS (1850–1990).

Figure 5:
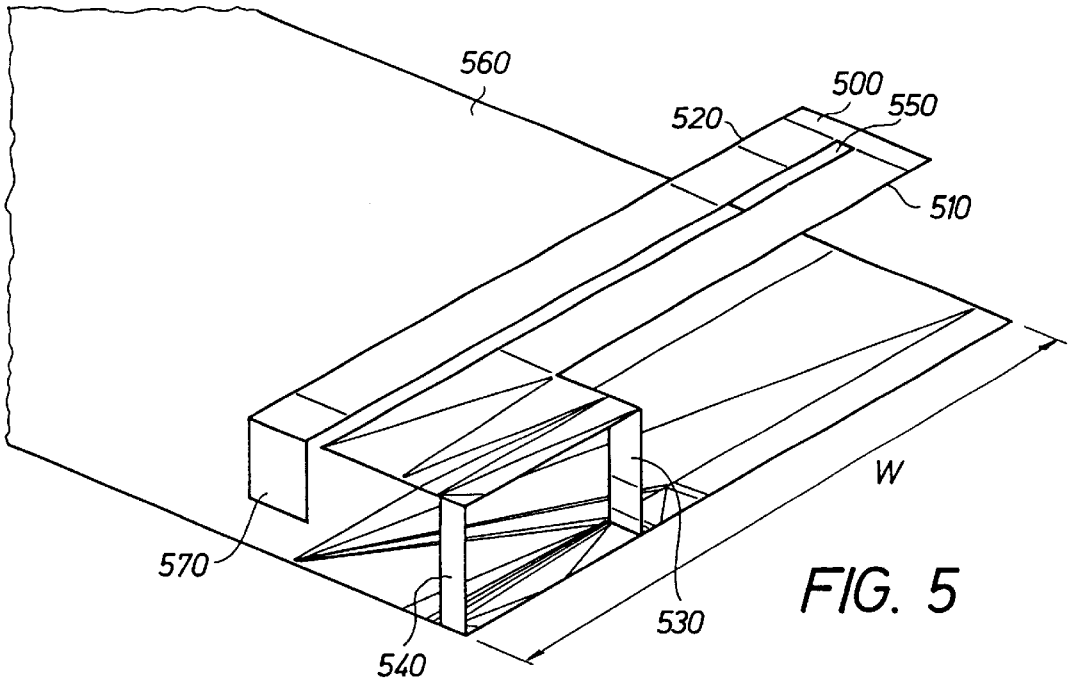
FIG. 5 illustrates a small-size folded PIFA antenna according to the present invention.

FIG. 5 discloses the geometry of a folded PIFA type antenna 500 without parasitic parts. In this specific embodiment the width W of the antenna 500 is approximately 45 mm (about the same width as the Printed Circuit Board, PCB) and the length is about 20 mm. The height of the radiating part (first part) 500 is about 8 mm over the PCB. The width of the slot between the radiating arms (first and second element) 510, 520 in the radiating part 500 is approximately between 1 and 3 mm. It should be realized that the length of the arms 510, 520 could be different in order to get a better matching or tuning. A dielectric substrate could be positioned between the radiating part and the PCB, which will be described more in detail with reference to FIG. 9. The feeding pin 530 and the ground pin 540 of the folded PIFA antenna 500, 510, are connected to the receiver/transmitter of the communication device 400 and the PCB-ground of the communication device 400, respectively. The radiating part 500 is folded into two elements, a first element 510 and a second element 520. The first element 510 comprises the ground pin 540 and the feeding pin 530, respectively. The second element 520 comprises the open end 570 of the antenna 500. The open end 570 could arbitrarily be bent down towards the PCB, wherein the bent part 570 of the second element could form an almost perpendicular angle in relation to the second element 520. The second element 520 of the first part 500 is bent since it must have a specific electrical length to be made resonate at a certain frequency. However, the width W of the PCB defines the physical width W of the antenna 500, 600. Thus, to bend the open end of the second element 570 is an advantageous way to increase the electrical length of the antenna and to improve the matching of the antenna without changing the physical width W. The first and the second element have approximately the same width as the PCB. The second element 520 of the radiating part is folded approximately 180 degrees in relation to the longitudinal axis of the first element 510. It has been empirically tested that by folding the radiating part, it is possible to decrease the resonance frequency. It has also been empirically verified that by selecting the right width and length of different parts of the folded elements 510, 520 and the right width of the slot 550 between the first and the second element of the radiating part, it is possible to tune the antenna to the desired frequencies. The antenna in FIG. 5 can be tuned to GSM/DCS or GSM/PCS frequencies. Unfortunately, the bandwidth at the high band, i.e., the DCS/PCS band, is too small to cover both the DCS and PCS without using a switching circuit.

Figure 7:
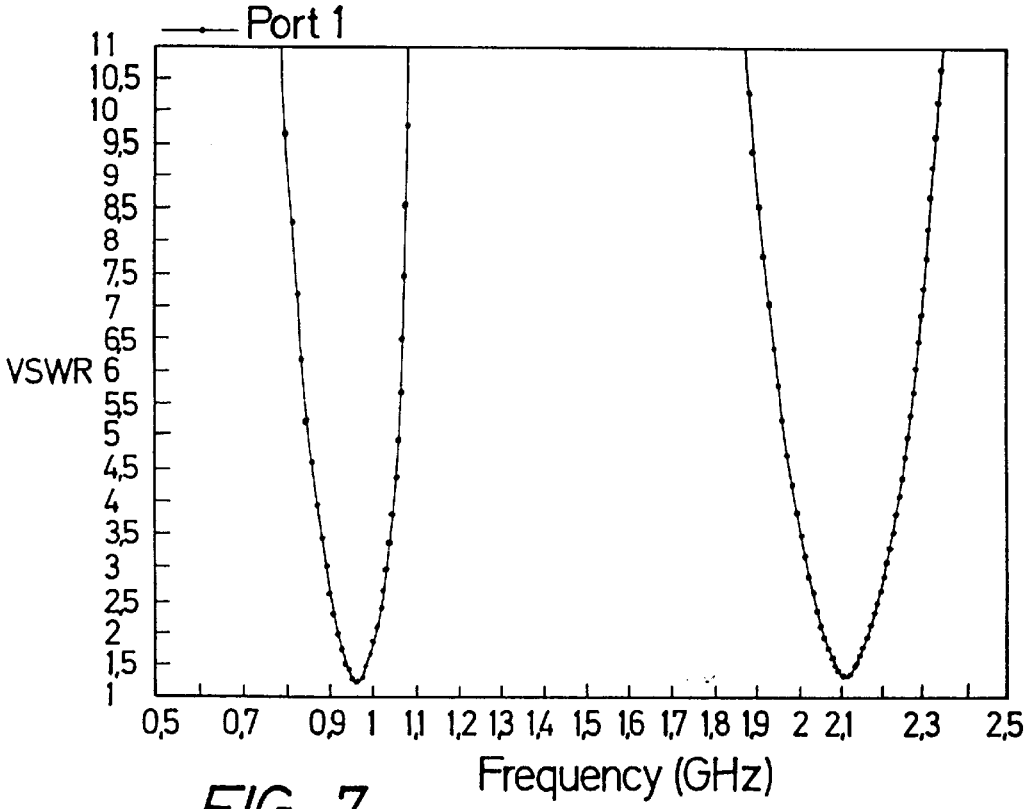
FIGS. 7 and 8 illustrate simulation results of the antennas in FIGS. 5 and 6, respectively.

FIG. 7 discloses VSWR plot of the folded PIFA antenna without the parasite element according to FIG. 5. As can be seen from this figure the antenna 500 is tuned to be operational at two frequency bands (GSM/DCS or GSM/PCS). The bandwidth at the higher frequency bands is too small to cover both DCS and PCS simultaneously.

The radiation properties of an antenna are determined by a number of different factors, one of which is the VSWR-value. VSWR (Voltage Standing Wave Ratio) has values between 1 and infinity. VSWR indicates the amount of interference between two opposite travelling waves in the transmission line feeding the antenna and describes the rate of the matching of the antenna to the desired impedance (usually 50Ω). One of the waves is the source feeding while the other is the reflection from the antenna back into the transmission line. The objective is to minimize this reflection. The maximum VSWR of infinity occurs when the reflected wave has the same intensity as the incident one, i.e., the whole signal is reflected and no power is provided at the radiating element 500, 510, 520, 600. The minimum VSWR of 1 occurs when the antenna is perfectly matched, i.e., no power is reflected and all power is transmitted to the radiator 500, 510, 520, 600. One usually designs the antenna to have a VSWR of less or equal to 2.5 of the desired frequencies.

Figure 6:
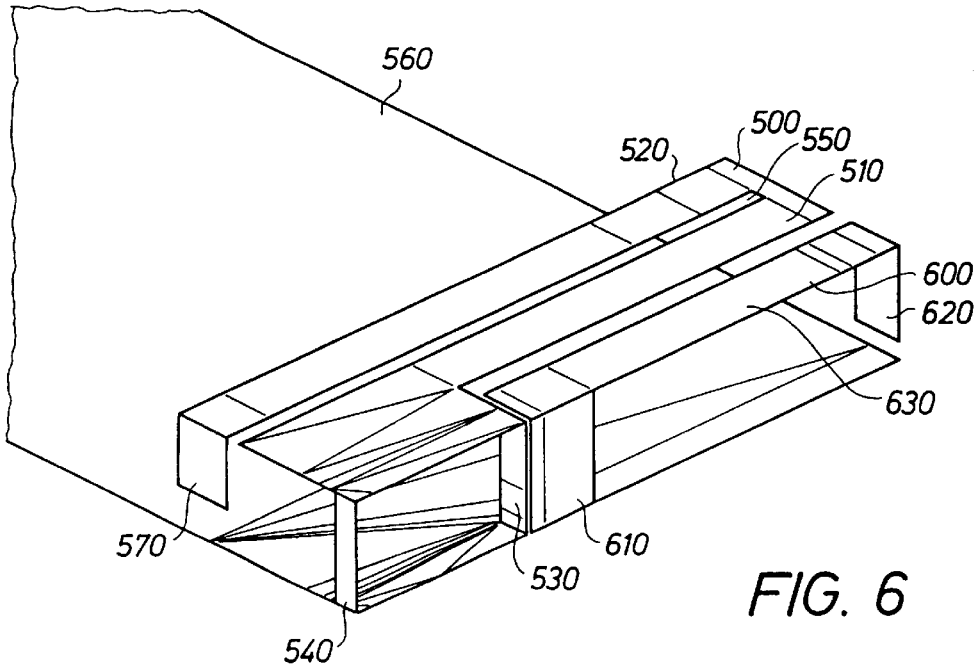
FIG. 6 illustrates a small size folded PIFA antenna with a parasitic element.

FIG. 6 discloses the geometry of the antenna 500, 600 according to the invention. The radiating part, i.e., the first part 500, of the antenna in this figure is the same as the radiating part 500, 510, 520 in FIG. 5. However, in order to increase the bandwidth at high band a parasitic element 600 (second part) is arranged in parallel to the radiating part, 510, or more specifically in parallel to the first element 510 of the radiating part 500. The parasitic element 600 has a main part 630 with an open end and is grounded at the other end 610. The main part 630 of the parasitic element 600 could have a bent portion 620 at its open end. This bent portion 620 towards the PCB could form an almost perpendicular angle in relation to the main part 630. The main part 630 of the parasitic element 600 is bent since it must have a specific electrical length to be made resonate at a certain frequency. However, the width W of the PCB defines the physical width W of the parasitic antenna 600. Thus, to bend the open end of the main part 620, 630 is an advantageous way to increase the electrical length of the parasitic antenna 600 (second part) and to improve the matching of the same antenna without changing the physical width W. The ground pin 610 of the parasitic element is placed in the close vicinity of the feeding pin 530 of the main radiator 500. The introduction of the parasitic element 600 results in an additional resonance, which can be tuned to occur at a frequency near the higher frequency band (DCS) of the main radiator 500. These two higher frequencies merge together building one broad resonance. The parasitic element 600 (second part) is capacitively connected to the radiating part 500, which will make it resonate at a higher frequency band, i.e., the PCS band. The length L of the parasitic element 600 is approximately given by the formula: $L=\lambda_3/4$, where $\lambda_3$ is the wavelength of the frequency to which the parasitic element is tuned, in this case the PCS band. However, it should be realized that the $\lambda_3$ could be the wavelength of an arbitrary frequency. The main radiating part 500 (first part) with its radiating arm 510 and 520 has a length L given approximately by the following formula: $L=\lambda_1/4=3*\lambda_2/4$, where $\lambda_1$ corresponds to the GSM frequency and $\lambda_2$ corresponds to the DCS band when the antenna is folded. It should be realized that the above formula should in this case be used for the folded antenna. By folding the antenna the resonance frequency in the higher frequency bands $f_2$, $\lambda_2$ is decreased in the frequency spectrum reaching the DCS band. For the skilled man it is obvious that $\lambda_1$ and $\lambda_2$ could be the wavelengths of arbitrary frequencies. The physical length L of the main radiating antenna 500 is approximately 9 cm. The parasitic element 600 is positioned approximately in parallel to the first element 510 of the main radiator 500. The distance between the first element and the parasitic element is approximately 1 to 3 mm. This distance can be arbitrarily varied depending on the tuning and the matching of the antenna. The distance between the ground pin of the parasitic element 600 and the feeding pin of the main radiator 500, 510 is approximately 0.5–1 mm. This distance can of course be arbitrarily varied to achieve adequate matching of the impedance of the antenna and tuning of the frequency bands. The matched antenna should have an almost fully resistive impedance of about 50Ω.

As mentioned above the overall dimensions of the folded PIFA antenna with the parasitic element are 45 mm×20 mm×8 mm. With these dimensions the antenna is capable of operating at GSM, DCS and PCS frequency bands. As already mentioned the position of the feeding pin and the ground pins as well as the lengths of the main and the parasitic elements 510, 520, 600, can be used for matching and tuning the antenna 500, 600. A larger height of the antenna influences the bandwidth of the antenna, and a larger height results in a larger bandwidth. The height of the antenna 500, 600 in FIG. 6 is about 8 mm above the ground plane (PCB-ground) which is enough for an antenna operating at GSM, DCS and PCS. It should be realized that the height of the antenna arbitrarily could be increased to cover an even broader spectrum, i.e., UMTS band (1920–2170 MHz). One skilled in the art will of course appreciate that other combinations of frequency bands may be implemented without departing from the spirit of the scope of the present invention. For example, other possibilities of low and high bands could include GSM+DCS+WCDMA, GSM+PCS+WCDMA, or any other combination of lower and higher frequency bands. The antenna of the present invention has small dimensions and can easily be integrated in a mobile terminal 400. For every mobile phone 400 it has to be retuned because the PCB ground as well as the back cover of the phone can influence the tuning to the appropriate frequency band.

Figure 8:
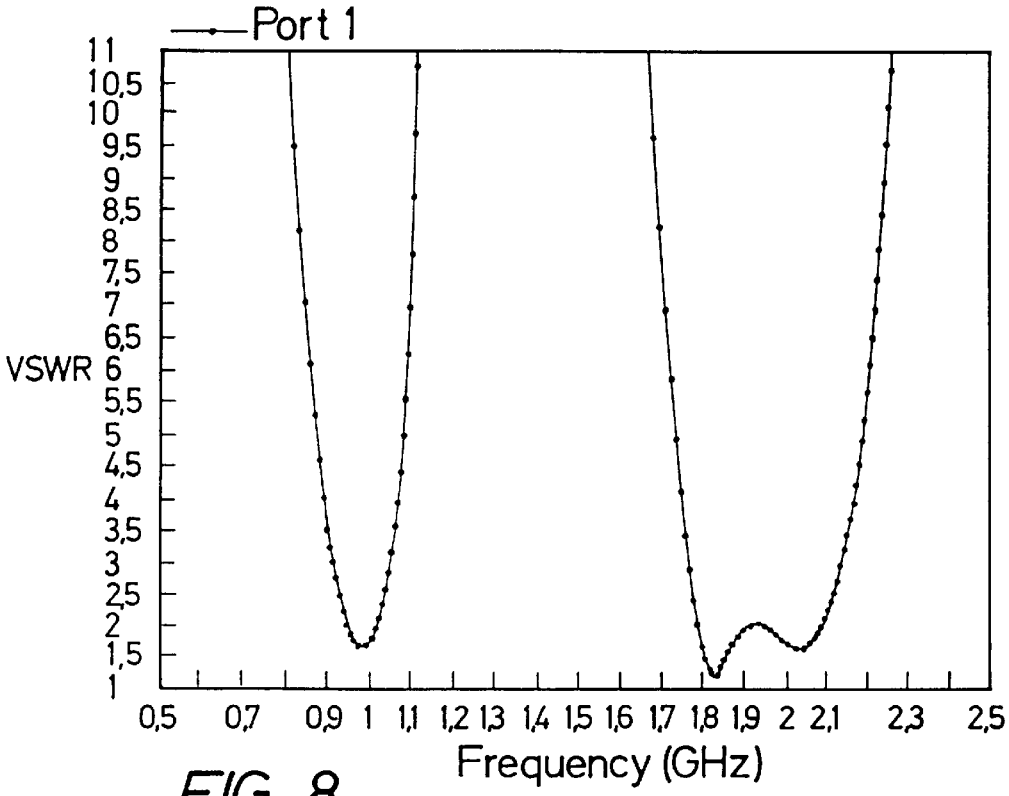

The VSWR plot of the antenna in FIG. 6 can be seen from FIG. 8. Thanks to the parasitic element 600 the VSWR plot has a new resonance at 2.05 GHz. The VSWR values are also very good and are less than 2 for all desired frequency bands, GSM, DCS and PCS.

The antenna design according to FIG. 6 was first simulated using Zeland IE3D software package. This software package is based on a moment method for solving electromagnetic field problems. After satisfying results had been achieved, a prototype was built to verify simulation results. As can be seen from FIG. 9, the antenna 500 with the parasitic element 600 was attached to a dielectric substrate 900 with a relative dielectric permitivity constant of approximately 1. The substrate had a height of approximately 8 mm and thus the distance between the antenna 500, 600 and the PCB ground 560 was about 8 mm. The achieved bandwidth was slightly less than the one indicated by the simulations. Gain measurements showed that gain values were about the same as for stubby antennas at GSM frequencies and 1–2 dB better at DCS/PCS frequencies. According to the above simulation the bandwidth at GSM frequencies is approximately 100 MHz and the bandwidth at DCS/PCS frequencies is approximately 300 MHz.

Figure 9:
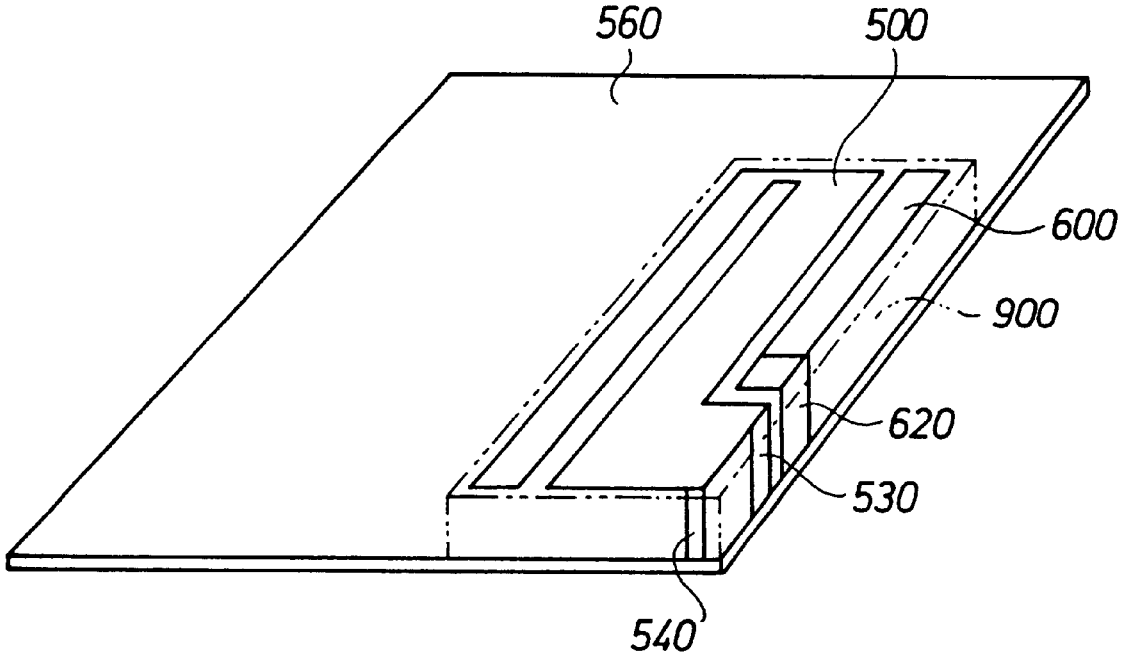
FIG. 9 illustrates the mounting of the antennas in FIGS. 5 and 6 on a Printed Circuit Board (PCB)

As can be seen from FIG. 9, the folded planar inverted PIFA antenna 500 with the parasitic element 600 according to the present invention is attached to the top of a substrate 900. The antenna 500, 600 is mounted at the edge of the PCB 560, which provides for better radiation efficiency and bandwidth. In addition, the PCB space requirement for the built-in antenna 500, 600 is minimized due to its small size. Thus, the substrate is normally placed and fastened on the upper part of the PCB 560. Consequently, when the PCB is mounted in the mobile phone 400 the antenna 500, 600 is arranged in the upper region 450 of the phone 400. The substrate could be made of a material with an arbitrary dielectric constant depending on the bandwidth etc. The ground pins 540, 610 and the feeding pin 530 of the antenna 500, 600 are connected to PCB ground 560 and receiver/transmitter 450, respectively, through the substrate 900. The antenna 500, 600 could for example be etched or printed on a ceramic or plastic substrate 900, which is suitable for mounting on a PCB. The substrate could also be replaced by dielectric legs keeping the antenna 500, 600 at an appropriate distance from the PCB. The antenna 500, 600 could also have been cut out and then placed on the above substrate, legs. The antenna could also be placed on the PCB 560 without using substrate or legs, which implies that there is an air space between the radiator 500, 600 and the PCB 560.

Figure 10:
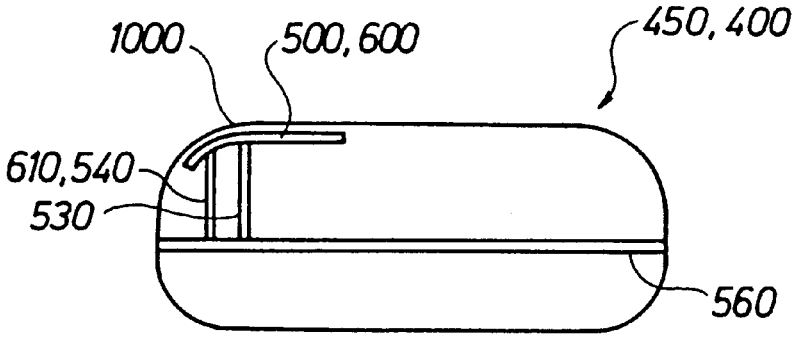
FIG. 10 illustrates a cross-sectional view of a mobile phone with the PCB and the antenna of the invention.

FIG. 10 discloses another preferable way to attach the antenna 500, 600 to the phone 400, 450. FIG. 10 is cross-sectional view of a mobile phone, the PCB 560 and the antenna 500, 600. In this embodiment, the antenna is attached to the back cover 1000 of the phone 450. The antenna seen in a section view is connected to the receiver/transmitter and the PCB 560 in the normal way by means of the feeding pin 530 and the ground pins 540, 610. Since the antenna is fastened to the back cover 1000 the whole height from the PCB 560 to the back cover can be used for increasing the bandwidth of the antenna as described earlier.

It should be realized that the antenna 500 without the parasitic element 600 (FIG. 5) could be attached and implemented in a phone chassis in the same way as the antenna described in connection with FIG. 6.

One skilled in the art will appreciate that an increase in the area or thickness of the substrate 900 or antenna size or a decrease in the value of the dielectric constant results in an increase of the bandwidth, which can be achieved. Moreover, the bandwidth also depends on the size and location of the slots in the antenna 500. It is obvious for the skilled man that the above-described antenna 500, 600 could have an arbitrary two-dimensional or three-dimensional structure.

It should be emphasised that the concept "comprises/comprising" when used in this specification is taken to specify the presence of stated features, integers, steps or components but does not preclude the presence or addition of one or more other features, integers, steps, components or groups thereof.

It would be appreciated by those of ordinary skill in the art that the present invention could be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalence thereof are intended to be embraced therein.

What is claimed is:

1. A communication device in a radio communication system, the device comprising:

a first interface for receiving information from a user;

a second interface for transmitting information to said user; and a built-in multiple band antenna comprising a first part and a second part, said first part being tuned to at least a first frequency band and a second frequency band;

wherein said second part is tuned to at least a third frequency band when electro-magnetically interacting with said first part.

2. The communication device according to claim 1, wherein:

said first interface contains one or more of a group consisting of a microphone, a keypad, a touchpad, a radio-port, an IR-port, a computer-port and a Bluetooth-port; and said second interface contains one or more of a group consisting of a speaker, a display, a radio-port, a computer-port, and a Bluetooth-port.

3. The communication device according to claim 1, wherein said second part is galvanically separated from said first part.

4. The communication device according to claim 1, wherein said first part has a first ground pin connected to a ground plane and to a feeding pin of the device.

5. The communication device according to claim 4, wherein said second part has a second ground pin connected to the ground plane and to a main element with an open end.

6. The communication device according to claim 1, wherein said first part is folded to form a first element and a second element, said first element comprising a first ground pin and a feeding pin, and said second element comprising a second ground pin and an open end.

7. The communication device according to claim 6, wherein the second element is folded at least 90 degrees in relation to a longitudinal axis of the first element.

8. The communication device according to claim 6, wherein the second element is folded approximately 180 degrees in relation to a longitudinal axis of the first element.

9. The communication device according to claim 6, wherein said first element of said first part, said second element of said first part, and said main element of said second part, are spaced apart and electrically separated from said ground plane by one of a group consisting of a dielectric substrate, legs, a plastic substrate and a ceramic substrate.

10. The communication device according to claim 6 wherein said main element of the second part is arranged in close vicinity of, and in parallel with, the first element of the first part.

11. The communication device according to claim 6, wherein said second ground pin of the second part is placed in close vicinity of the feeding pin of the first part.

12. The communication device according to claim 6, wherein said open end of the second element is bent down towards the ground plane to increase an electrical length of the second element without affecting its physical width W.

13. The communication device according to claim 6, wherein said open end of the main element is bent down towards the ground plane to increase an electrical length of the main element without affecting its physical width W.

14. The communication device according to claim 6 wherein a slot between the first and the second elements of the first part has a width of between approximately 1 to 3 mm.

15. The communication device according to claim 6 wherein the first and the second elements of the first part, and the second part have different lengths and widths to achieve an arbitrary tuning to a specific frequency.

16. The communication device according to claim 6 further comprising:

a substrate of a predetermined thickness, onto which said first part and second part are mounted;

wherein said substrate is mounted on a PCB comprising said ground plane.

17. The communication device according to claim 16, wherein said substrate is a ceramic substrate or a plastic substrate.

18. The communication device according to claim 1 wherein said second part is arranged in close vicinity of, and in parallel with, the first part.

19. The communication device according to claim 1, wherein said first frequency band corresponds to GSM, said second frequency band corresponds to DCS and said third frequency band corresponds to PCS.

20. The communication device according to claim 1, wherein the built-in multiple band antenna has a length of approximately 20 mm, a width of approximately 45 mm and a height over ground of approximately 8 mm.

21. The communication device according to claim 1, wherein said built-in multiple band antenna is attached to a back cover of said communication device.

22. A built-in antenna for a radio communication device, comprising:

a first part tuned to at least a first frequency band and a second frequency band; and a second part disposed to electro-magnetically interact with said first part, said second part being tuned to at least a third frequency band when electromagnetically interacting with said first part.

23. The built-in antenna according to claim 22, wherein said second part is galvanically separated from said first part.

24. The built-in antenna according to claim 22, wherein said first part comprises a first ground pin and a feeding pin, the first ground pin being disposed to connect to a ground plane and the feeding pin being disposed to connect to a transmitter/receiver.

25. The built-in antenna according to claim 24, wherein said second part comprises a second ground pin and a main element, the second ground pin being disposed to connect to the ground plane, and the main element having an open end.

26. The built-in antenna according to claim 22, wherein said first part is folded to form a first element and a second element, said first element comprising a first ground pin and a feeding pin, and said second element comprising a second ground pin and an open end.

27. The built-in antenna according to claim 26, wherein the second element is folded at least 90 degrees in relation to a longitudinal axis of the first element.

28. The built-in antenna according to claim 26, wherein the second element is folded approximately 180 degrees in relation to a longitudinal axis of the first element.

29. The built-in antenna according to claim 26, wherein the first element of said first part, said second element of said first part, and the main element of said second part, are spaced apart and electrically separated from said ground plane by one of a group consisting of a dielectric substrate, legs, a plastic substrate and a ceramic substrate.

30. The built-in antenna according to claim 26, wherein said main element of the second part is arranged in close vicinity of, and in parallel with, the first element of the first part.

31. The built-in antenna according to claim 26, wherein said second ground pin is placed in close vicinity of the feeding pin of the first part.

32. The built-in antenna according to claim 26, wherein said open end of the second element is bent down towards the ground plane to increase an electrical length of the second element without affecting its physical width W.

33. The built-in antenna according to claim 26, wherein said open end of the main element is bent down towards the ground plane to increase an electrical length of the main element without affecting its physical width W.

34. The built-in antenna according to claim 26, wherein a slot between the first and the second element of the first part has a width of approximately 1 to 3 mm.

35. The built-in antenna according to claim 26, wherein the first and the second elements of the first part, and the second part have different lengths and widths to achieve an arbitrary tuning to a specific frequency.

36. The built-in antenna according to claim 26, further comprising:

a substrate with a predetermined thickness, onto which said first part and second part are mounted;

wherein said substrate is mounted on a PCB comprising said ground plane.

37. The built-in antenna according to claim 36 wherein said substrate is a ceramic substrate or a plastic substrate.

38. The built-in antenna according to claim 36, wherein said PCB comprising the substrate is mounted on a chassis inside a radio communication device.

39. The built-in antenna according to claim 22, wherein said second part is arranged in close vicinity of, and in parallel with, the first part.

40. The built-in antenna according to claim 22, wherein said first frequency band corresponds to GSM, said second frequency band corresponds to DCS and said third frequency band corresponds to PCS.

41. The built-in antenna according to claim 22, wherein the built-in multiple band antenna has a length of approximately 20 mm, a width of approximately 45 mm and a height over ground plane of approximately 8 mm.

42. The built-in antenna according to claim 22, wherein said built-in antenna has an arbitrary two or three-dimensional shape.

43. The built-in antenna according to claim 22, wherein the first part has a length corresponding to the first frequency band within which it is made resonant, and to the second frequency band within which it is made resonant, said second frequency band being approximately twice as high as said first frequency band.

44. The built-in antenna according to claim 22, wherein the second part has a length corresponding to approximately ¼ wavelength of the third frequency to which it is made resonant.

45. The built-in antenna according to claim 22, wherein said antenna is attached to a back cover of a mobile communication device.

* * * * *